US008221014B1

(12) United States Patent
Houston

(10) Patent No.: US 8,221,014 B1
(45) Date of Patent: Jul. 17, 2012

(54) LIPSTICK APPLICATOR BRUSH ATTACHMENT SYSTEM

(76) Inventor: Mary I. Houston, Lithonia, GA (US)

( * ) Notice: Subject to any disclaimer, the term of this patent is extended or adjusted under 35 U.S.C. 154(b) by 368 days.

(21) Appl. No.: 12/554,032

(22) Filed: Sep. 4, 2009

(51) Int. Cl.
*A46B 11/00* (2006.01)

(52) U.S. Cl. ..... 401/125; 401/123; 132/297; 132/314

(58) Field of Classification Search ..... 401/123–125; 132/294, 297, 314, 317; 220/736
See application file for complete search history.

(56) References Cited

U.S. PATENT DOCUMENTS

| | | | | |
|---|---|---|---|---|
| D144,145 | S | 3/1946 | Silson | |
| 2,522,403 | A * | 9/1950 | Ross | 132/316 |
| 2,552,714 | A | 5/1951 | Gardiner | |
| 2,804,082 | A | 8/1957 | Dewing | |
| 5,178,478 | A | 1/1993 | Ryder | |
| 5,226,541 | A * | 7/1993 | Huang | 206/581 |
| 5,715,848 | A | 2/1998 | Conley, Jr. | |
| 6,450,179 | B2 * | 9/2002 | Bengis | 132/297 |
| 7,007,700 | B2 | 3/2006 | Burroughs | |

* cited by examiner

*Primary Examiner* — David Walczak

(57) ABSTRACT

A lipstick applicator brush attachment system includes a tube that has a first end, a second end and a peripheral wall. The tube has a lipstick column positioned therein. The tube has a break therein to allow the tube to be opened to access the lipstick column. A container has a closed end, an open end and a perimeter wall extending between the open and closed ends. A cap is removably positioned on the container to close the open end. The cap frictionally engages the perimeter wall. An applicator brush is removably positioned in the container. The applicator brush has a plurality of bristles abuttable against the lipstick column to place lipstick on the bristles for application to a person's lips. A coupler is attached to the container. The coupler releasably couples the container to the tube.

4 Claims, 3 Drawing Sheets

LIPSTICK APPLICATOR BRUSH ATTACHMENT SYSTEM

BACKGROUND OF THE DISCLOSURE

1. Field of the Disclosure

The disclosure relates to brush attachment devices and more particularly pertains to a new brush attachment device for attaching a brush to a lipstick container so that the brush may be used to fully utilize a column of lipstick.

2. Summary of the Disclosure

An embodiment of the disclosure meets the needs presented above by generally comprising a tube that has a first end, a second end and a peripheral wall that is attached to and extends between the first and second ends. The tube has a lipstick column positioned therein. The tube has a break therein to allow the tube to be opened to access the lipstick column. A container has a closed end, an open end and a perimeter wall extending between the open and closed ends. The open end allows access into an interior of the container. A cap is removably positioned on the container to close the open end. The cap frictionally engages the perimeter wall. An applicator brush is removably positioned in the container. The applicator brush has a plurality of bristles abuttable against the lipstick column to place lipstick on the bristles for application to a person's lips. A coupler is attached to the container. The coupler releasably couples the container to the tube.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
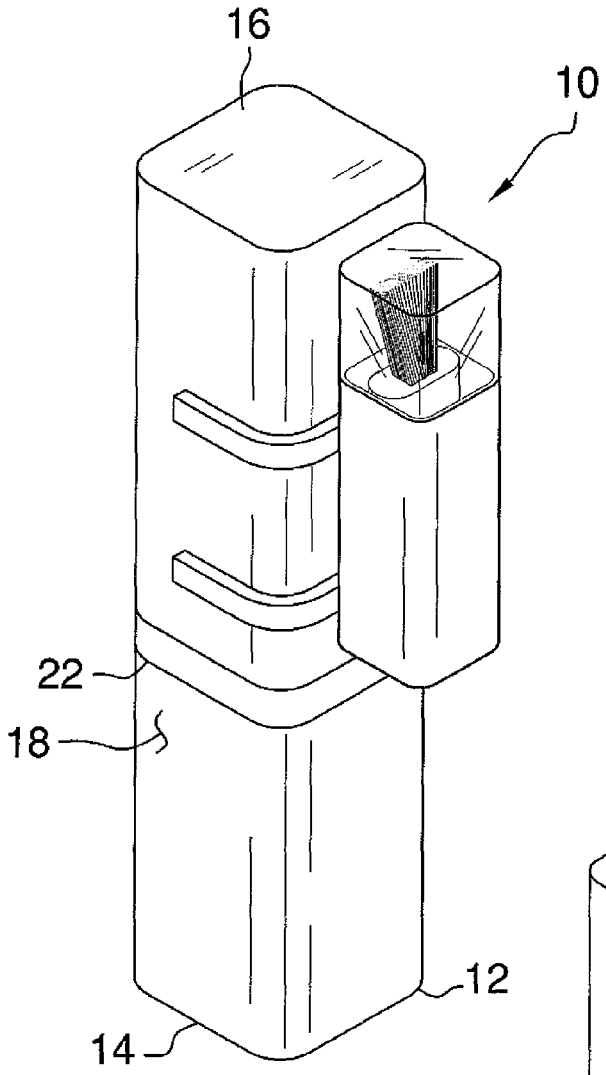
FIG. 1 is a top perspective view of a lipstick applicator brush attachment system according to an embodiment of the disclosure.
Figure 2:
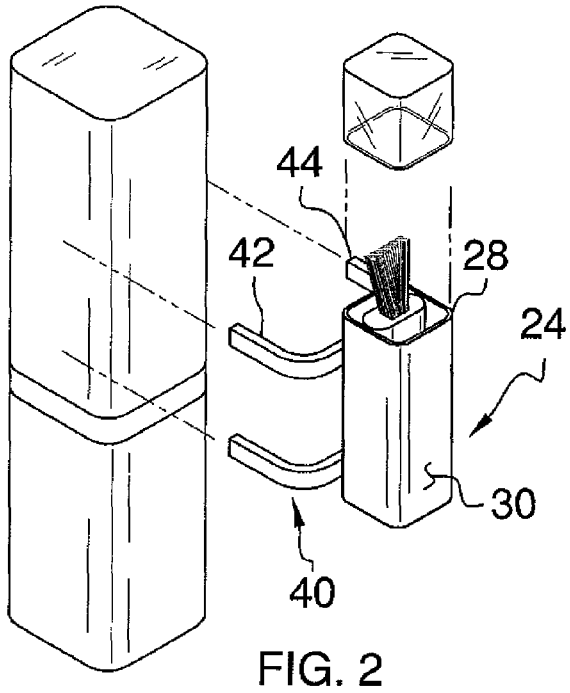
FIG. 2 is an exploded top perspective view of an embodiment of the disclosure.
Figure 3:
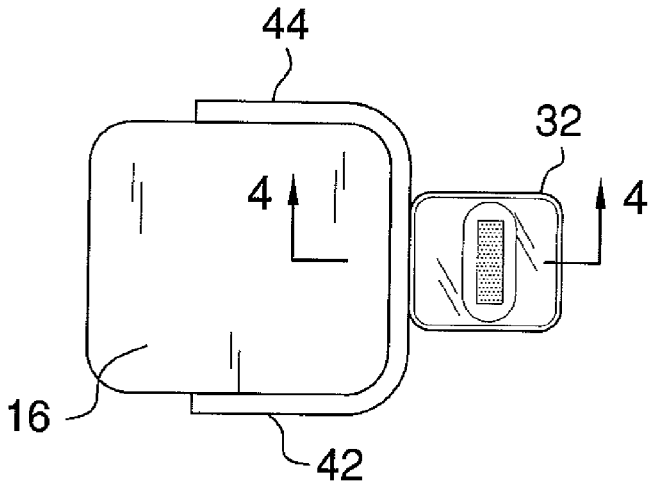
FIG. 3 is a top view of an embodiment of the disclosure.
Figure 4:
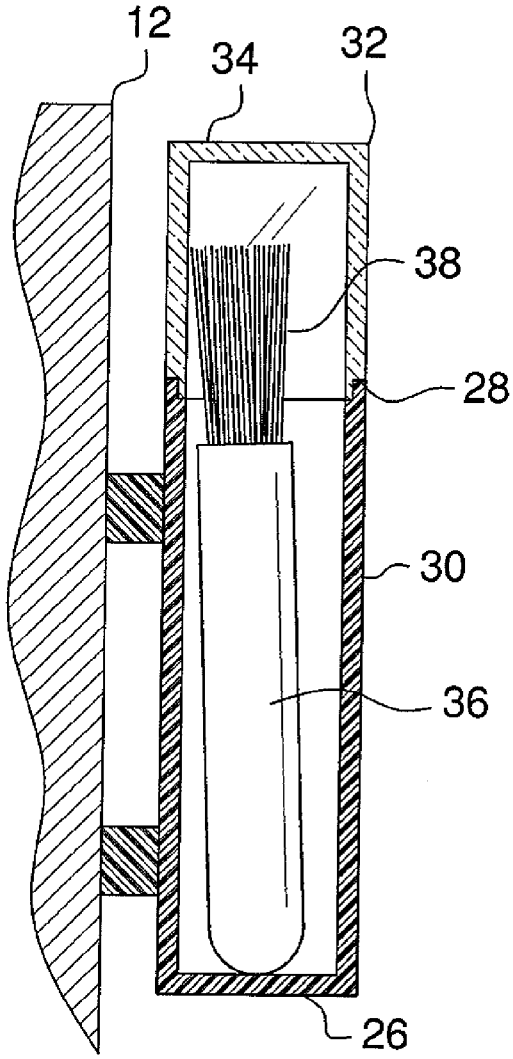
FIG. 4 is a cross-sectional view taken along line 4-4 of FIG. 3 of an embodiment of the disclosure.
Figure 5:
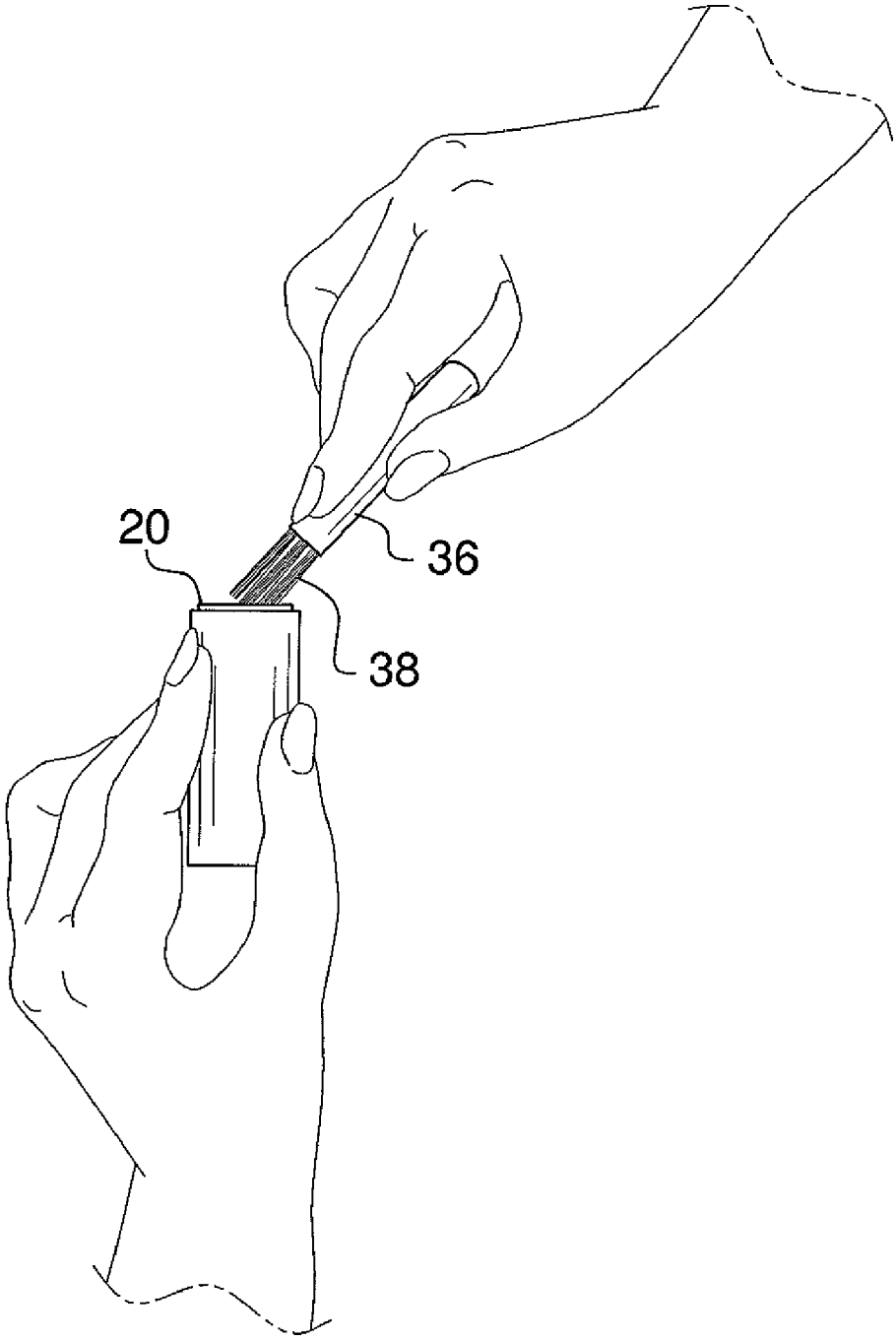
FIG. 5 is a side in-use view of an embodiment of the disclosure.

With reference now to the drawings, and in particular to FIGS. 1 through 5 thereof, a new brush attachment device embodying the principles and concepts of an embodiment of the disclosure and generally designated by the reference numeral 10 will be described.

As best illustrated in FIGS. 1 through 5, the lipstick applicator brush attachment system 10 generally comprises a tube

12 that has a first end 14, a second end 16 and a peripheral wall 18 that is attached to and extends between the first 14 and second 16 ends. The tube 12 has a lipstick column 20 positioned therein. The tube 12 and lipstick column 20 comprise a conventional lipstick application assembly. The tube 12 has a break 22 therein to allow the tube 12 to be opened to access the lipstick column 20. A first length dimension is defined from the first end 14 to the second end 16.

A container 24 has a closed end 26, an open end 28 and a perimeter wall 30 extending between the open 28 and closed 26 ends. The open end 28 allows access into an interior of the container 24. A cap 32 is removably positioned on the container 24 to close the open end 28. The cap 32 frictionally engages the perimeter wall 30. The container 24 has a second length dimension that is defined from the closed end 26 to a distal end 34 of the cap 32 with respect to the closed end 26. The first length dimension is larger than the second length dimension.

An applicator brush 36 is removably positioned in the container 24. The applicator brush 36 has a plurality of bristles 38 abuttable against the lipstick column 20 to'place lipstick on the bristles 38 for application to a person's lips.

A coupler 40 attached to the container 24. The coupler 40 releasably couples the container 24 to the tube 12. The coupler 40 includes two pairs of arms 42, 44. Each of the pairs of arms includes a first 42 and a second 44 arm each extending away from the container 40 in a same direction with respect to each other. The container 24 is removably positioned between and frictionally coupled to associated ones of the first 42 and second 44 arms.

In use, the container 24 holds the brush 36 in a convenient position to allow a person to use the brush 36 for lipstick application. This will allow a person to utilize the brush 36 instead of directly applying the lipstick to their lips. Moreover, the brush 36 would allow a person to fully use the entire lipstick column 20 as opposed to having to discard the end of the column 20 since it may not be easily applied directly to the lips.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An applicator brush attachment system, said system including:

a tube having a first end, a second end and a peripheral wall being attached to and extending between said first and second ends, said tube having a lipstick column positioned therein, said tube having a break therein to allow said tube to be opened to access said lipstick column;

a container having a closed end, an open end and a perimeter wall extending between said open and closed ends, said open end allowing access into an interior of said container, a cap being removably positioned on said container to close said open end, said cap frictionally engaging said perimeter wall;

an applicator brush being removably positioned in said container, said applicator brush having a plurality of bristles being abuttable against the lipstick column to place lipstick on the bristles for application to a person's lips; and a coupler being attached to said container, said coupler releasably coupling said container to said tube, said perimeter wall being positioned adjacent and lateral to said peripheral wall when said container is attached to said tube such that a longitudinal axis of said tube is orientated parallel to and spaced laterally from a longitudinal axis of said container, said longitudinal axis of said container extending through said open and closed ends thereof, said longitudinal axis of said tube extending through said first and second ends thereof.

2. The system according to claim 1, wherein a first length dimension is defined from said first end to said second end, said container having a second length dimension being defined from said closed end to a distal end of said cap with respect to said closed end, said first length dimension being greater than said second length dimension.

3. The system according to claim 1, wherein said coupler includes at least one pairs of arms, said container removably positioned between and frictionally coupled to said arms.

4. An applicator brush attachment system, said system including:

a tube having a first end, a second end and a peripheral wall being attached to and extending between said first and second ends, said tube having a lipstick column positioned therein, said tube having a break therein to allow said tube to be opened to access said lipstick column, a first length dimension being defined from said first end to said second end;

a container having a closed end, an open end and a perimeter wall extending between said open and closed ends, said open end allowing access into an interior of said container, a cap being removably positioned on said container to close said open end, said cap frictionally engaging said perimeter wall, said container having a second length dimension being defined from said closed end to a distal end of said cap with respect to said closed end, said first length dimension being greater than said second length dimension;

an applicator brush being removably positioned in said container, said applicator brush having a plurality of bristles being abuttable against the lipstick column to place lipstick on the bristles for application to a person's lips; and a coupler being attached to said container, said coupler releasably coupling said container to said tube, said coupler including two pairs of arms, each of said pairs of arms including a first and a second arm each extending away from said container in a same direction with respect to each other, said container being removably positioned between and frictionally coupled to associated ones of said first and second arms.

* * * * *